US010240617B2

(12) United States Patent
Russalian

(10) Patent No.: US 10,240,617 B2
(45) Date of Patent: Mar. 26, 2019

(54) WATER PUMP BEARING WITH ACTIVE CONDENSATE PURGING SYSTEM

(71) Applicant: Schaeffler Technologies AG & Co. KG, Herzogenaurach (DE)

(72) Inventor: Vigel Russalian, Macomb, MI (US)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 818 days.

(21) Appl. No.: 14/789,146

(22) Filed: Jul. 1, 2015

(65) Prior Publication Data

US 2017/0002838 A1 Jan. 5, 2017

(51) Int. Cl.

| | |
|---|---|
| ***F16C 33/72*** | (2006.01) |
| ***F04D 29/70*** | (2006.01) |
| ***F04D 29/42*** | (2006.01) |
| ***F04D 29/18*** | (2006.01) |
| ***F04D 29/10*** | (2006.01) |
| ***F04D 29/043*** | (2006.01) |
| ***F04D 29/046*** | (2006.01) |
| ***F01P 5/10*** | (2006.01) |

(52) U.S. Cl.

CPC ..... *F04D 29/708* (2013.01); *F01P 5/10* (2013.01); *F04D 29/043* (2013.01); *F04D 29/046* (2013.01); *F04D 29/106* (2013.01); *F04D 29/18* (2013.01); *F04D 29/426* (2013.01)

(58) Field of Classification Search

CPC .... F16C 33/726; F04D 29/708; F04D 29/043; F04D 29/046; F04D 29/106; F04D 29/18; F04D 29/426

See application file for complete search history.

(56) References Cited

U.S. PATENT DOCUMENTS

| | | | | |
|---|---|---|---|---|
| 4,768,923 | A * | 9/1988 | Baker | F04D 29/628 277/371 |
| 5,217,350 | A * | 6/1993 | Kimura | F04D 29/049 415/175 |
| 5,226,786 | A * | 7/1993 | Dorski | F04D 29/426 277/590 |
| 5,322,373 | A * | 6/1994 | Oakes | F16C 33/664 384/462 |
| 5,950,577 | A * | 9/1999 | Sasaki | F04D 29/108 123/41.44 |
| 6,029,695 | A * | 2/2000 | Logan | F16L 27/0828 137/580 |
| 2012/0134789 | A1* | 5/2012 | Murakami | F04D 13/02 415/182.1 |
| 2015/0128415 | A1* | 5/2015 | Russalian | F04D 29/049 29/888.02 |

* cited by examiner

*Primary Examiner* — Thomas R Hannon

(74) *Attorney, Agent, or Firm* — Volpe and Koenig, P.C.

(57) ABSTRACT

A coolant pump with an integrated shaft bearing (ISB) assembly is provided. The ISB has a bearing housing, and at least one bearing located therein supports a shaft. A bearing seal is connected to the bearing housing at a first axial end and contacts the shaft, and a vent cover is also located at the first axial end to define a vent space between it and the bearing seal. A seal assembly is located between the shaft and the vent cover. A vent insert is located in the vent space and connected for rotation with the shaft. Venting air enters via a vent space inlet connected to the vent space, and is exhausted by a vent space outlet. A generally annular collection cavity is located inside the vent space and connected to the vent space outlet. This allows for active purging of condensate or coolant leakage to protect the bearing.

20 Claims, 7 Drawing Sheets

WATER PUMP BEARING WITH ACTIVE CONDENSATE PURGING SYSTEM

FIELD OF INVENTION

The present invention relates to water pumps used in connection with internal combustion engines.

BACKGROUND

It is known in connection with water pumps to use a pre-assembled integrated shaft bearing which is installed in a water pump housing, along with a separate mechanical seal that is installed to isolate the bearing from the engine coolant fluid on the impeller side of the shaft. In some cases, coolant leakage through the mechanical seal is purposely used to lubricate the mechanical seal faces. However, this coolant leakage can create condensate on the bearing seal lip areas. The condensate as well as any excess leakage of coolant through the mechanical seal raises the risk of condensate and/or coolant intrusion into the bearing, resulting in early bearing failure. Also, excessive grease leakage from the bearing in the region of the seal can block the condensate leakage vent hole resulting in a pressure build-up in the space between the mechanical seal and the bearing, which can also result in coolant intrusion into the bearing and early bearing failure.

It would be desirable to provide a water pump in which the known arrangements are improved to prevent early bearing failure due to these potential leakage issues.

SUMMARY

In one aspect, a coolant pump is provided including a pump housing with an integrated shaft bearing assembly located in the pump housing. The integrated shaft bearing includes a bearing housing and at least one bearing located in the bearing housing that supports a shaft that extends through the bearing housing. A bearing seal is connected to the bearing housing at a first axial end and contacts the shaft. A vent cover is located at the first axial end of the bearing housing, with the vent cover extending radially toward the shaft and defining a vent space between the bearing seal and the vent cover. A seal assembly is located between the shaft and the vent cover. A vent insert having a radially extending surface is located in the vent space and connected to the shaft for rotation therewith. A vent space inlet is connected to the vent space and a vent space outlet is also connected to the vent space. A generally annular collection cavity is located inside the vent space and is connected to the vent space outlet. The pump includes an inlet opening in communication with the vent space inlet and an outlet opening in communication with the vent space outlet. Based on this arrangement, any condensation and/or coolant leakage which is used to lubricate the mechanical seal contact surface for the bearing are actively purged via the vent insert in order to prevent water intrusion into the bearing. This prevents early bearing failure. Additionally, any excessive grease purge from the bearing is preferably also contained at the bearing seal and/or can be purged to the extent necessary via the active purging system.

In one aspect, an impeller is located in the pump housing and connected to the shaft on the same axial end as the vent cover, and a pulley is connected on an opposite axial end of the shaft.

Preferably, an external collection reservoir is provided on or connected to the pump housing in an area of the outlet opening.

In one preferred arrangement, the generally annular collection cavity has a volute shape in order to direct any condensate, coolant leakage and/or grease which passes through the bearing seal to the vent space outlet. Preferably, the outlet opening is arranged downwardly in a use position to allow for easier drainage.

In another aspect, the vent insert includes through holes that extend from the first axial side to the second axial side. Depending upon the arrangement, the vent inlet is preferably located on the first axial side of the vent insert and the vent outlet is located on the second axial side and the through holes promote air flow from the vent inlet through the vent insert to the vent outlet. Preferably, radially extending vanes are located on one or both axial sides of the vent insert, depending upon the particular arrangement.

In one preferred aspect, the vent insert includes an annular flange on the first axial side that at least partially surrounds a contact area between the bearing seal and the shaft. This is used in order to capture excessive grease which escapes through the bearing seal.

In a preferred arrangement, the vent insert tapers to a reduced thickness from a radially inner portion to a radial outer portion.

In one arrangement, the inlet opening is located in the pump housing. In another arrangement, the inlet opening extends through the shaft to the vent space.

In one arrangement, the vent cover is part of a vent ring that includes an axially extending generally cylindrical portion that abuts the bearing housing at the first axial end. The vent space inlet and the vent space outlet are located in the axially extending generally cylindrical portion.

The generally annular collection cavity that is shaped as a volute can be formed in the vent ring, or can be formed in the housing.

In a preferred variant, the vent space inlet is located in the bearing housing on the first axial side of the vent insert and the vent space outlet is located in the bearing housing on the second axial side of the vent insert. In this arrangement, preferably the radial vanes on the vent insert are only located on the second axial side. In another arrangement, with the vent space inlet being located through the shaft, the vanes are located on both axial sides of the vent insert in order to promote an outward flow of any condensate, coolant leakage or other material toward the generally annular collection cavity.

In another aspect of the invention, an integrated shaft bearing assembly for use in a coolant pump is provided. The integrated shaft bearing assembly includes the bearing housing as well as at least one bearing located in the bearing housing that supports the shaft that extends through the bearing housing. Preferably, two bearings are provided. A bearing seal is connected to the bearing housing at a first axial end and contacts the shaft. Preferably, a second bearing seal is also provided at the second axial end of the bearing housing and contacts the shaft at the second axial end as well. A vent cover is located at the first axial end of the bearing housing, which can be a separate flat cover or formed as a vent ring having a cylindrical portion that extends from the flat cover as discussed above. A seal assembly is located between the shaft and the vent cover. This isolates the wet side of the coolant pump from the bearing side. A vent insert having a radially extending surface is located in the vent space and is connected to the shaft for rotation therewith. A vent space inlet is connected to the vent space and a vent space outlet is also connected to the vent space. A generally annular collection cavity is located in the vent space and is connected to the vent outlet. This collects any condensate or excess coolant leakage which is actively purged via rotation of the vent insert in order to remove the condensate, excess coolant leakage, and/or other materials through the vent space outlet.

In one aspect, the vent space inlet is formed through an opening in the shaft. In another aspect, it is formed through an opening in the vent ring. Alternatively, it can be formed in a portion of the bearing housing.

BRIEF DESCRIPTION OF THE DRAWINGS

The foregoing Summary and the following detailed description will be better understood when read in conjunction with the appended drawings, which illustrate a preferred embodiment of the invention. In the drawings.

DETAILED DESCRIPTION OF THE PREFERRED EMBODIMENTS

Figure 1:
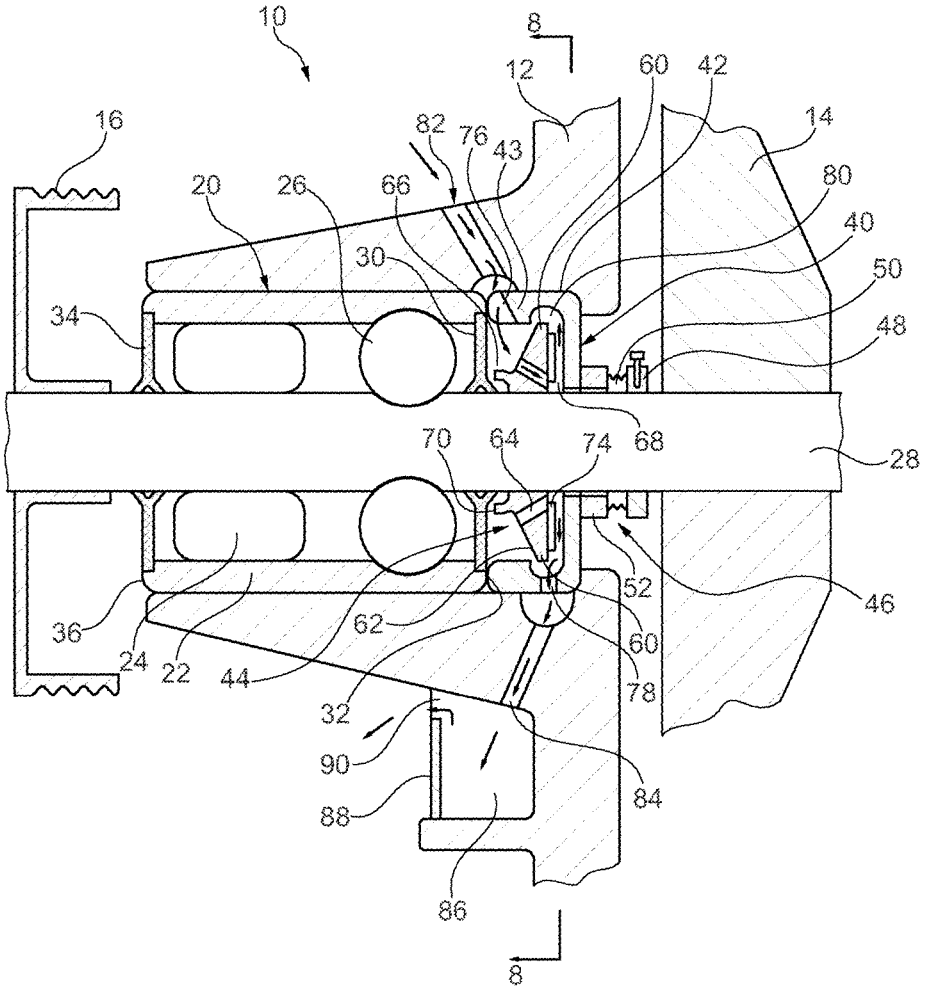
FIG. 1 is a cross-sectional view through a first embodiment of a coolant pump having an integrated shaft bearing assembly.

Certain terminology is used in the following description for convenience only and is not limiting. The words "front," "rear," "upper" and "lower" designate directions in the drawings to which reference is made. The words "inwardly" and "outwardly" refer to directions toward and away from the parts referenced in the drawings. "Axially" refers to a direction along the axis of a shaft or rotating part. A reference to a list of items that are cited as "at least one of a, b, or c" (where a, b, and c represent the items being listed) means any single one of the items a, b, or c, or combinations thereof. The terminology includes the words specifically noted above, derivatives thereof and words of similar import.

Referring to FIG. 1, a coolant pump 10 according to a first preferred arrangement is shown. The coolant pump 10 includes a pump housing 12, typically made of machined or cast aluminum. An integrated shaft bearing assembly (ISB) 20 is located in the pump housing 12. The ISB 20 includes at least one bearing 24, and more preferably two bearings 24, 26, located in the bearing housing 22 that support a shaft 28 that extends through the bearing housing 22. In the typical coolant pump arrangement, an impeller 14 is located on one end of the shaft 28 and a pulley 16 is located on the opposite end of the shaft 28 and can be driven, for example, via an auxiliary drive belt of an internal combustion engine. A bearing seal 30 is connected to the bearing housing 22 at a first axial end 32 of the bearing housing 22 and preferably contacts the shaft 28. Preferably, a second bearing seal 34 is located at the second axial end 36 of the bearing housing 22 and also contacts the shaft 28 in order to provide a sealed bearing area which can, for example, be pre-lubricated with a lubricant.

A vent cover 40 is located at the first axial end 32 of the bearing housing 22. The vent cover 40 in the first embodiment of the coolant pump 10 is part of a vent ring 42 which includes the generally flat radially extending cover 40 which is integrally connected with an axially extending generally cylindrical portion 43 that abuts the bearing housing 22 at the first axial end 32. However, as discussed in detail below, the vent cover 40 can be a separate part formed as a generally flat disc. The vent cover 40 extends radially inwardly from the axial end of the bearing housing 22 toward the shaft 28 and defines a vent space 44 between the bearing seal 30 and the vent cover 40. A seal assembly 46 is located between the shaft 28 and the vent cover 40. One arrangement of the seal assembly 46 is shown and includes a clamping ring 48 that is connected to the shaft 28 as well as a bellows 50, which is preferably elastic and pre-loaded in a direction toward the vent cover 40, as well as a seal element 52 that rides on the vent cover 40. The seal element 52 is preferably made of an elastomeric seal material and may have a PTFE coating at the moving contact face.

A vent insert 60 having a radially extending surface 62 is located in the vent space 44 and connected for rotation with the shaft 28. The vent insert 60 includes a first axial side 66 and a second axial side 68. Preferably through holes 64 extend from the first axial side 66 to the second axial side 68. The vent insert is shown in detail in FIG. 2. A vent space inlet 76 is connected to the vent space 44. In the embodiment shown in FIG. 1, the vent space inlet 76 extends through the cylindrical portion 43 of the vent ring 42. However, it could also extend through a portion of the bearing housing 22 as explained in detail in connection with the further embodiments described below. In FIG. 1, the vent space inlet 76 is located on the first axial side 66 of the vent insert 60. A vent space outlet 78 is also connected to the vent space 44 and here it is located on the second axial side 68 of the vent insert 60. In the embodiment shown in FIG. 1, vanes 74 are located on the second side of the vent insert 60. These vanes 74 extend radially and are used to actively purge the vent space.

Preferably, an annular flange 70 is located on the vent insert 60 facing the bearing seal 30. The annular flange 70 preferably partially surrounds a portion of the bearing seal 30 where it contacts the shaft 28, forming a grease reservoir for excess grease which may be purged from inside the ISB 20 past the bearing seal 30.

Figure 8:
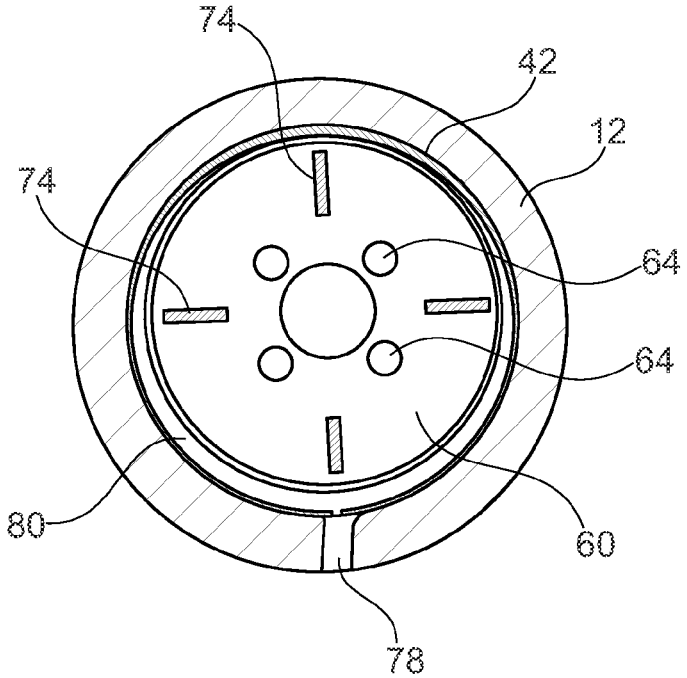
FIG. 8 is a cross-sectional view taken along line 8-8 in FIG. 1 showing the volute shaped annular collection cavity formed in the vent ring.
Figure 9:
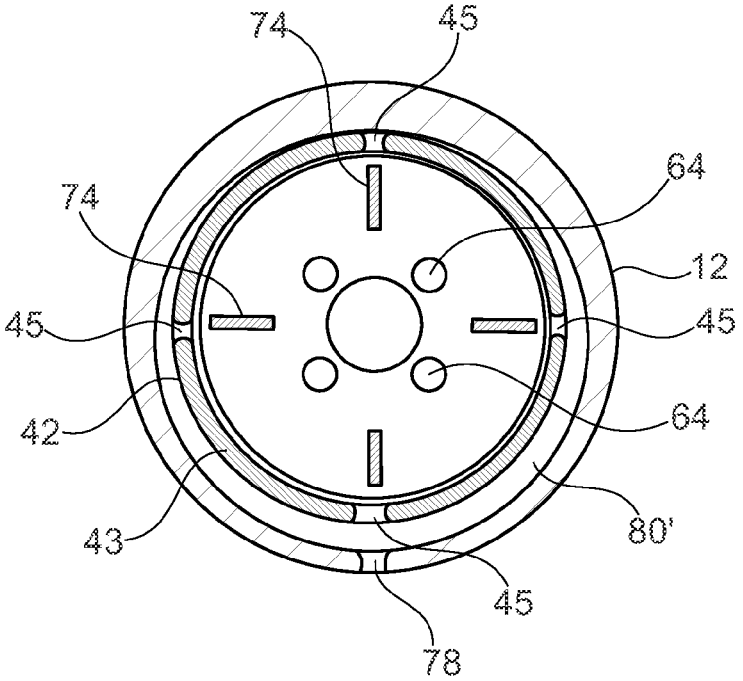
FIG. 9 is a cross-sectional view similar to FIG. 8 showing an alternate arrangement with the volute shaped annular collection cavity formed in the housing outside of the vent ring.

Still with reference to FIG. 1, a generally annular collection cavity 80, preferably in the form of a volute formed in the vent ring 42 as shown in FIG. 8, is located inside the vent space 44 and is connected to the vent space outlet 78. Preferably, the generally annular collection cavity 80 is located on the second axial side 68 of the vent insert 60, on the opposite side from the vent space inlet 76. Here, the vent insert 60 divides the vent space 44 into the inlet side on the first axial side 66 and the outlet side on the second axial side 68 which includes the radially extending vanes 74. Alternatively, as shown in FIG. 9, the generally annular collection cavity 80' in the form of a volute can be formed in the housing 12, and openings 45 are located in the cylindrical wall portion 43 of the vent ring 42

The pump 10 further includes an inlet opening 82, located in the pump housing 12 in the embodiment of FIG. 1, that is in communication with the vent space inlet 76, and an outlet opening 84, which is in communication with the vent space outlet 78. Preferably, the outlet opening 84 discharges into an external collection reservoir 86 connected to the pump housing 12 in an area of the outlet opening 84. This can be formed by a wall 88 that includes an opening 90 at the top thereof, with the wall 88 being attached to the pump housing 12. Preferably, in order to promote drainage from the vent space 44, the outlet opening 84 is arranged downwardly in a use position of the coolant pump 10.

Figure 2:
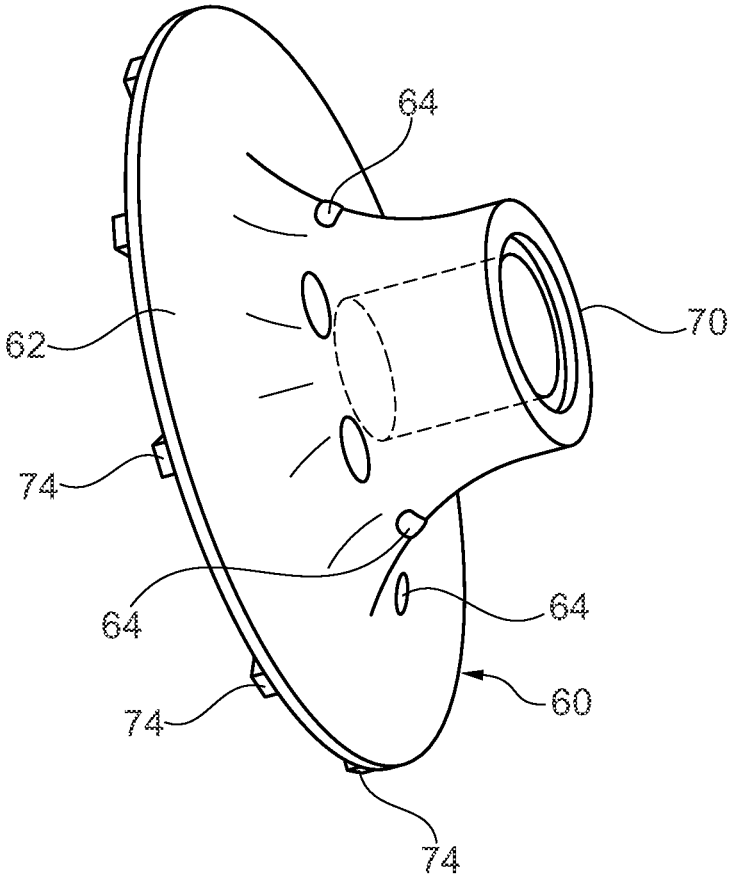
FIG. 2 is a detail perspective view of the vent insert used in the integrated shaft bearing assembly.

Referring to FIGS. 1 and 2, the through hole 64 in the vent insert 60 extend from the first axial side 66 to the second axial side 68. These holes preferably extend radially inwardly as the through holes 64 progress from the first axial side 66 to the second axial side 68 in order to promote airflow and purging of the vent space 44. However, the through holes 64 could also be parallel to the bearing axis. Any condensation, excess coolant leaking through the seal assembly 46, or excessive grease that escapes through the bearing seal 30 are actively purged via rotation of the vent insert 60 with the shaft 28 creating an airflow from the vent space inlet 76 into the portion of the vent space 44 located on the first axial side 66 of the vent insert 60, through the holes 64 to the second axial side 68 where the condensation, excess coolant and/or grease are moved radially outwardly via the vanes 74 where they are gathered by the annular collection cavity 80, 80' and directed toward the vent space outlet 78 where they are discharged. This prevents condensation and excess coolant from entering the bearing components of the ISB 20, helping to prevent premature failure.

In the embodiment illustrated in FIGS. 1 and 2, the vent insert 60 tapers to a reduced thickness from a radially inner portion to a radially outer portion. However, it could also be a generally constant thickness disc with the annular flange 70 extending axially to at least partially surround the contact area between a bearing seal 30 and a shaft 28.

Figure 3:
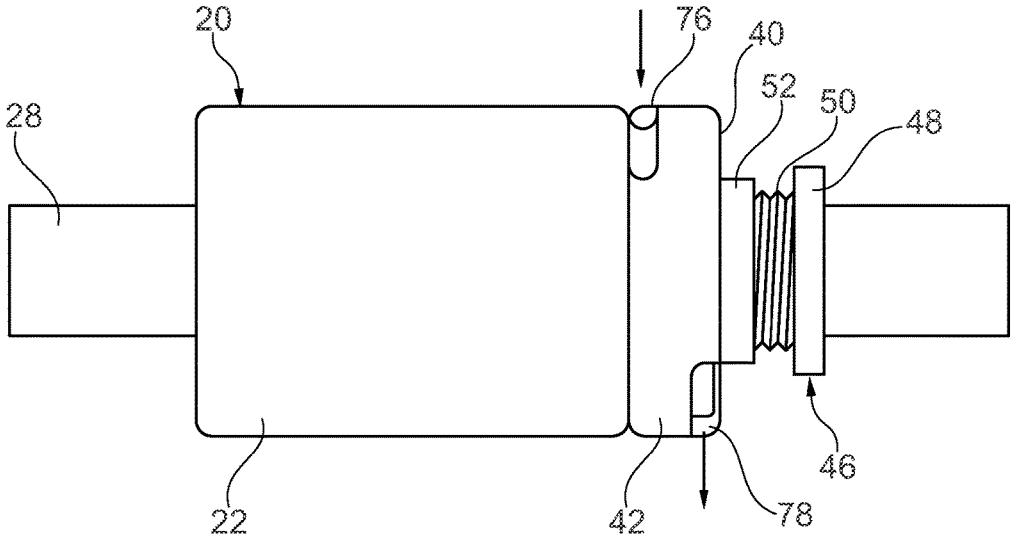
FIG. 3 is a side elevational view of the integrated shaft bearing assembly of FIG. 1.

The coolant pump 10 is preferably provided as a pre-assembled unit. The ISB 20 as described above in connection with the coolant pump 10 can be also provided as a separate pre-assembled unit that can be later assembled with the pump housing 12 as well as the impeller 14 and pulley 16 during assembly of the coolant pump 10. The separately assembled ISB 20 is shown in FIG. 3 including the housing 22 and the shaft 28 extending therethrough along with the vent ring 42 having the vent cover 40 formed therewith as well as the seal assembly 46 that seals the ISB from the wet portion of the coolant pump 10. The vent space inlet 76 as well as the vent space outlet 78 formed in the vent ring 42 is also shown.

Figure 4:
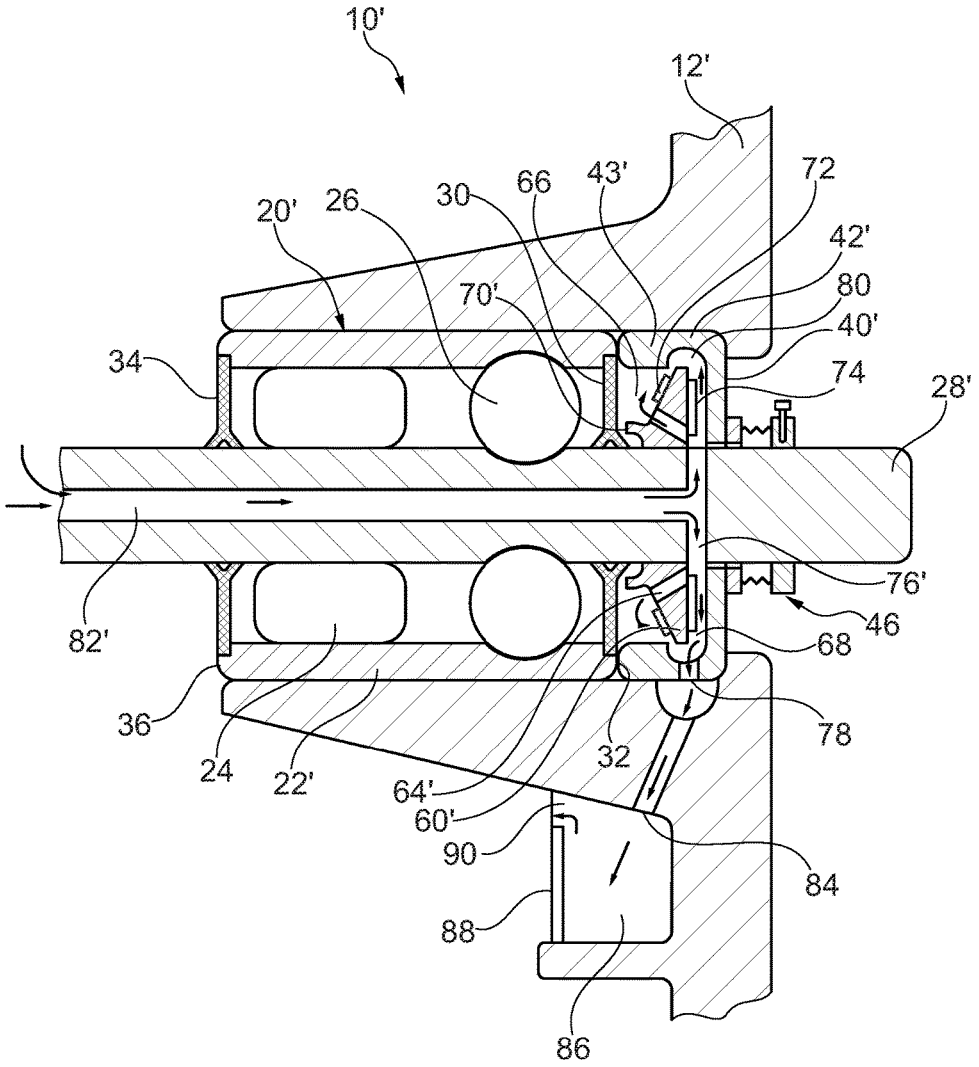
FIG. 4 is a cross-sectional view through a second embodiment of a coolant pump with an integrated shaft bearing assembly.

Referring now to FIG. 4, a second embodiment of a water pump 10' is shown. The second embodiment of the water pump 10' is similar to the first embodiment 10 discussed above and like element numbers have been used to designate the same elements. Elements with similar functions have been identified with a prime. Here, the ISB 20' is provided with a shaft 28' having an opening 82' extending preferably axially at least partially therethrough to the vent space 44. The vent space inlet 76' is preferably formed via a cross bore through the shaft 28' that intersects the axially extending opening 82'. This allows venting air to be drawn in from the pulley side of the coolant pump 10'. The ISB 20' preferably includes the first and second bearing seals 30, 34 as discussed above. As shown in FIG. 4, the vent space inlet 76' is located on the second axial side 68 of the vent insert 60' which preferably still includes through holes 64' which are angled inwardly from the first axial side 66 toward the second axial side 68 of the vent space 44. Here however, radially extending vanes 72 are provided on the first axial side and radially extending vanes 74 are provided on the second axial side. The seal assembly 46 is preferably the same as discussed above. In use, outside air is drawn through the opening 82' in the shaft 28' and is forced outwardly via the vanes 72, 74 on both axial sides of the vent insert 60'. In order to actively purge excess coolant, condensation, and/or excess grease that escapes through the seal 30 toward the generally annular collection cavity 80 where it is delivered to the vent space outlet 78 and transferred to the outlet opening 84 preferably into the external collection reservoir 86. This arrangement of the coolant pump 10' provides the same functionality as the coolant pump 10 described above while providing the inlet opening 82' as part of the ISB 20' rather than requiring the vent inlet opening to be added to the pump housing 12'.

Figure 5:
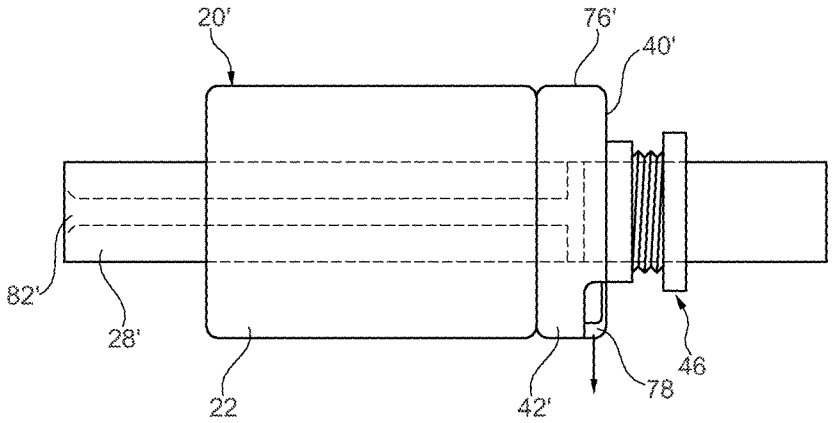
FIG. 5 is a side view of the integrated shaft bearing assembly from the coolant pump of FIG. 4.
Figure 6A:
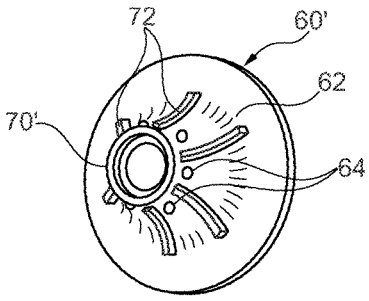
FIG. 6A and 6B are detail perspective views of the vent insert used in the coolant pump of FIG. 4.
Figure 6B:
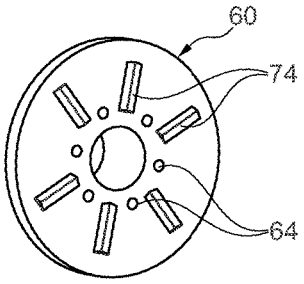

FIG. 5 shows the ISB 20' as used in the second embodiment of the coolant pump 10'. FIGS. 6A and 6B are detail views of the vent insert 60' showing the vanes 72 and 74 located on both axial sides as well as the through holes 64.

Figure 7:
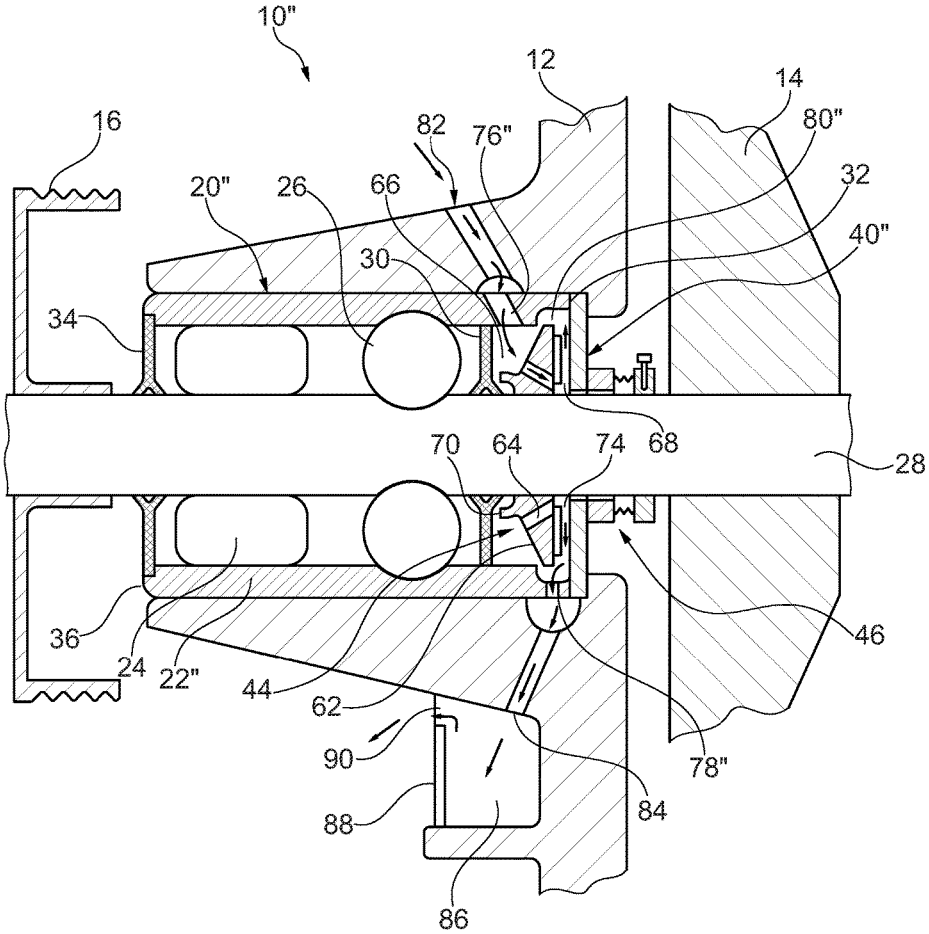
FIG. 7 is a cross-sectional view through a third embodiment of a coolant pump with an integrated shaft bearing assembly.

Referring now to FIG. 7, a third embodiment of a coolant pump 10" is shown. The third embodiment of the coolant pump 10" is similar to the first embodiment of the coolant pump 10, and like elements have been identified with similar reference numerals. Elements that share the same function have been identified with a double prime.

As shown in FIG. 7, the vent cover 40" is provided as a separate disc, which can be formed of stamped sheet metal. The vent ring of the first embodiment has been eliminated and the bearing housing 22" has been extended, with the annular collection cavity 80" being formed at the first axial end 32 of the bearing housing 22". The vent cover 40" can be adhered with a sealant to the first axial end 32 of the bearing housing 22" for pre-assembly. The vent space inlet 76" is formed through the bearing housing 22" as is the vent space outlet 78". Otherwise, the coolant pump 10" is functionally the same as the coolant pump 10 described above, with vent air being drawn into the vent space 44 through rotation of the vent insert 60 with the radial vanes 74 on the second axial side 68 forcing condensation, excess coolant, and/or grease that escapes past the bearing seal 30 from the bearing chamber radially outwardly into the annular collection cavity 80 where it is directed toward the vent space outlet 78".

This arrangement potentially allows for reduced production costs for the pre-assembled ISB 20" due to the vent cover 40" being formed as a flat stamped disc rather than as the vent ring 42 as described above.

Having thus described the present invention in detail, it is to be appreciated and will be apparent to those skilled in the art that many physical changes, only a few of which are exemplified in the detailed description of the invention, could be made without altering the inventive concepts and principles embodied therein. It is also to be appreciated that numerous embodiments incorporating only part of the preferred embodiment are possible which do not alter, with respect to those parts, the inventive concepts and principles embodied therein. The present embodiment and optional configurations are therefore to be considered in all respects as exemplary and/or illustrative and not restrictive, the scope of the invention being indicated by the appended claims rather than by the foregoing description, and all alternate embodiments and changes to this embodiment which come within the meaning and range of equivalency of said claims are therefore to be embraced therein.

What is claimed is:

1. A coolant pump comprising:

a pump housing;

an integrated shaft bearing assembly located in the pump housing, including:

a bearing housing;

at least one bearing located in the bearing housing that supports a shaft that extends through the bearing housing;

a bearing seal connected to the bearing housing at a first axial end and contacting the shaft;

a vent cover located at the first axial end of the bearing housing, the vent cover extends toward the shaft and defines a vent space between the bearing seal and the vent cover;

a seal assembly located between the shaft and the vent cover;

a vent insert having a radially extending surface with first and second axial sides located in the vent space and connected for rotation with the shaft;

a vent space inlet connected to the vent space, and a vent space outlet connected to the vent space; and a generally annular collection cavity located inside the vent space and connected to the vent space outlet;

wherein the pump includes an inlet opening in communication with the vent space inlet and an outlet opening in communication with the vent space outlet.

2. The coolant pump of claim 1, further comprising:

an impeller located in the pump housing and connected to the shaft on a same axial end as the vent cover, and a pulley connected to an opposite axial end of the shaft.

3. The coolant pump of claim 1, further comprising:

an external collection reservoir connected to the pump housing in an area of the outlet opening.

4. The coolant pump of claim 1, wherein the generally annular collection cavity has a volute shape.

5. The coolant pump of claim 1, wherein the outlet opening is arranged downwardly in a use position.

6. The coolant pump of claim 1, wherein the vent insert includes through holes that extend from the first axial side to the second axial side.

7. The coolant pump of claim 1, wherein the vent insert includes radially extending vanes on the second axial side.

8. The coolant pump of claim 1, wherein the vent insert includes an annular flange on the first axial side that at least partially surrounds a contact area between the bearing seal and the shaft.

9. The coolant pump of claim 1, wherein the vent insert tapers to a reduced thickness from a radially inner portion to a radially outer portion.

10. The coolant pump of claim 1, wherein the inlet opening is in the pump housing.

11. The coolant pump of claim 1, wherein the inlet opening is through the shaft.

12. The coolant pump of claim 11, wherein the vent insert includes radially extending vanes on the first and second axial sides.

13. The coolant pump of claim 1, wherein the vent cover is part of a vent ring that includes an axially extending generally cylindrical portion that abuts the bearing housing at the first axial end, and the vent space inlet and vent space outlet are located in the axially extending generally cylindrical portion.

14. The coolant pump of claim 1, wherein the vent space inlet is located in the bearing housing on the first axial side of the vent insert, and the vent space outlet is located in the bearing housing on the second axial side of the vent insert.

15. An integrated shaft bearing assembly for a coolant pump, comprising:

a bearing housing;

at least one bearing located in the bearing housing that supports a shaft that extends through the bearing housing;

a bearing seal connected to the bearing housing at a first axial end and contacting the shaft;

a vent cover located at the first axial end of the bearing housing, the vent cover extends toward the shaft and defines a vent space between the bearing seal and the vent cover;

a seal assembly located between the shaft and the vent cover;

a vent insert having a radially extending surface located in the vent space and connected for rotation with the shaft;

a vent space inlet connected to the vent space, and a vent space outlet connected to the vent space; and a generally annular collection cavity located inside the vent space and connected to the vent space outlet.

16. The integrated shaft bearing assembly of claim 15, wherein the generally annular collection cavity has a volute shape.

17. The integrated shaft bearing assembly of claim 15, wherein the vent insert includes through holes that extend from the first axial side to the second axial.

18. The integrated shaft bearing assembly of claim 15, wherein the vent insert includes radially extending vanes on the second axial side.

19. The integrated shaft bearing assembly of claim 15, wherein the vent insert includes an annular flange on the first axial side that at least partially surrounds a contact area between the bearing seal and the shaft.

20. The integrated shaft bearing assembly of claim 15, wherein the vent space inlet is formed by an opening extending through the shaft.

* * * * *